US007423476B2

(12) United States Patent
Tang

(10) Patent No.: US 7,423,476 B2
(45) Date of Patent: Sep. 9, 2008

(54) CURRENT MIRROR CIRCUIT HAVING DRAIN-SOURCE VOLTAGE CLAMP

(75) Inventor: Qiang Tang, Fremont, CA (US)

(73) Assignee: Micron Technology, Inc., Boise, ID (US)

( * ) Notice: Subject to any disclaimer, the term of this patent is extended or adjusted under 35 U.S.C. 154(b) by 18 days.

(21) Appl. No.: 11/526,947

(22) Filed: Sep. 25, 2006

(65) Prior Publication Data

US 2008/0074174 A1 Mar. 27, 2008

(51) Int. Cl.
*G05F 1/10* (2006.01)

(52) U.S. Cl. ..... 327/543; 327/309

(58) Field of Classification Search ..... None
See application file for complete search history.

(56) References Cited

U.S. PATENT DOCUMENTS

| | | | | |
|---|---|---|---|---|
| 4,954,992 | A * | 9/1990 | Kumanoya et al. | 365/207 |
| 5,436,552 | A * | 7/1995 | Kajimoto | 323/313 |
| 5,910,914 | A | 6/1999 | Wang | 365/185.21 |
| 6,069,821 | A | 5/2000 | Jun et al. | 365/185.21 |
| 6,529,417 | B2 | 3/2003 | Roohparvar | 365/185.33 |
| 6,845,047 | B2 | 1/2005 | Ikehashi et al. | 365/189.01 |
| 6,937,495 | B2 | 8/2005 | Scheurlein | 365/105 |
| 6,946,882 | B2 | 9/2005 | Gogl et al. | 327/53 |
| 6,980,458 | B2 | 12/2005 | Demange et al. | 365/145 |
| 6,982,908 | B2 | 1/2006 | Cho | 365/189.06 |
| 6,999,365 | B2 | 2/2006 | Takano et al. | 365/207 |
| 7,023,736 | B2 | 4/2006 | Cernea et al. | 365/185.21 |
| 7,038,960 | B2 | 5/2006 | Tran et al. | 365/205 |
| 7,046,568 | B2 | 5/2006 | Cernea | 365/207 |
| 7,215,172 | B2 * | 5/2007 | Ito | 327/309 |
| 2005/0286305 | A1 | 12/2005 | O | 365/185.21 |
| 2006/0092689 | A1 | 5/2006 | Braun et al. | 365/158 |
| 2006/0119409 | A1 | 6/2006 | Ito | 327/309 |
| 2006/0152970 | A1 | 7/2006 | DeBrosse et al. | 365/171 |
| 2006/0158947 | A1 | 7/2006 | Chan et al. | 365/210 |
| 2006/0221714 | A1 | 10/2006 | Li et al. | 365/189.01 |
| 2006/0285391 | A1 | 12/2006 | Cernea | 365/185.22 |

* cited by examiner

*Primary Examiner*—Cassandra Cox
(74) *Attorney, Agent, or Firm*—Dorsey & Whitney LLP

(57) ABSTRACT

A circuit and method for providing an output current that includes biasing an output transistor in accordance with a reference current to conduct the output current and further includes maintaining a voltage across the output transistor. One embodiment includes conducting a reference current through a diode-coupled first field-effect transistor (FET) and biasing a gate of a second FET matched to the diode-coupled first FET by a voltage equal to a gate voltage of the diode-coupled first FET. A current equal to the reference current is conducted through a third FET having a gate coupled to a drain of the second FET, the third FET matched to the second FET.

40 Claims, 4 Drawing Sheets

CURRENT MIRROR CIRCUIT HAVING DRAIN-SOURCE VOLTAGE CLAMP

TECHNICAL FIELD

The present invention relates generally to current sources, and more specifically, to current mirror circuits providing an output current based on a reference current.

BACKGROUND OF THE INVENTION

Current mirror circuits are widely used in a variety of electronic circuits to copy or scale a reference current. FIG. 1 illustrates a conventional p-channel metal-oxide-semiconductor (PMOS) current mirror circuit 100. Although shown in FIG. 1 and described below with respect to PMOS transistors, the following discussion applies to n-channel metal-oxide-semiconductor (NMOS) current mirror circuits as well. The current mirror circuit 100 includes a first PMOS transistor 110 coupled to a voltage supply providing voltage Vcc. A drain of the PMOS transistor 110 is coupled to a gate and further coupled to a current source 114 that establishes a reference current Iref through the first PMOS transistor. With the gate and drain of the PMOS transistor 110 coupled together, the drain-source voltage Vds and the gate-source voltage Vgs are equal. Additionally, as known, the PMOS transistor 110 is forced into saturation by coupling the gate to the drain. The current mirror circuit 100 further includes a second PMOS transistor 120 coupled to the voltage supply and having a gate coupled to the gate of the first PMOS transistor 110. The PMOS transistor 120 is matched to the PMOS transistor 110, that is, the PMOS transistor 120 has the same transistor characteristics as the PMOS transistor 110. As a result of the gate coupling and matched transistor characteristics, the Vgs of the PMOS transistor 120 is set to the Vgs of the PMOS transistor 110, and consequently, the PMOS transistor 120 conducts an output current Iout that is equal to Iref. This can be shown by the equation for drain current Ids of a PMOS transistor in saturation:

$$Ids=(1/2)\mu Cox(W/L)(Vgs-Vth)^2 \quad (1)$$

With PMOS transistors 110 and 120 matched and Vgs for the two PMOS transistors 110, 120 the same, Iout (i.e., Ids for PMOS transistor 120) will be equal to Iref (i.e., Ids for PMOS transistor 110).

As known, equation (1) is a simplified equation for drain current that does not account for channel length modulation. In MOS transistors having relatively long channel lengths, channel length modulation can be ignored as in equation (1) and provide a good approximation of drain current. However, for transistors having shorter channel lengths, the effect of channel length modulation on drain current Ids becomes more significant, enough so that changes in Vds for a given Vgs can cause variation of the Ids that is unacceptable in applications that rely on a consistent magnitude of current for Iout. In the current mirror circuit 100, as previously discussed, the Vgs of the PMOS 120 is set by the PMOS transistor 110 and current source 114. As previously discussed, if the PMOS 120 has a relatively short channel length, variation in Vds of the PMOS 120 will cause the Iout to vary as well due to channel length modulation. Where it is desirable for Iout to be stable, the variation in Iout may be unacceptable.

The Vds of the PMOS 120 can vary for several reasons, for example, fluctuation of Vcc provided by the voltage supply, changes in operating temperature, and the like. Utilizing transistors for the PMOS transistors 110, 120 having longer channel length can be used to reduce variations in the Ids current due to reduced effect of channel length modulation. The longer channel length transistors, however, occupy greater space on a semiconductor substrate, and can also having decreased response time in comparison to transistors having shorter channel length. Both of these results are generally viewed as undesirable.

Therefore, there is a need for a current mirror circuit that can provide a stable output current when utilized with transistors of different transistor dimensions.

DETAILED DESCRIPTION OF PREFERRED EMBODIMENTS

Certain details are set forth below to provide a sufficient understanding of the invention. However, it will be clear to one skilled in the art that the invention may be practiced without these particular details. Moreover, the particular embodiments of the present invention described herein are provided by way of example and should not be used to limit the scope of the invention to these particular embodiments. In other instances, well-known circuits, control signals, and timing protocols have not been shown in detail in order to avoid unnecessarily obscuring the invention.

Figure 1:
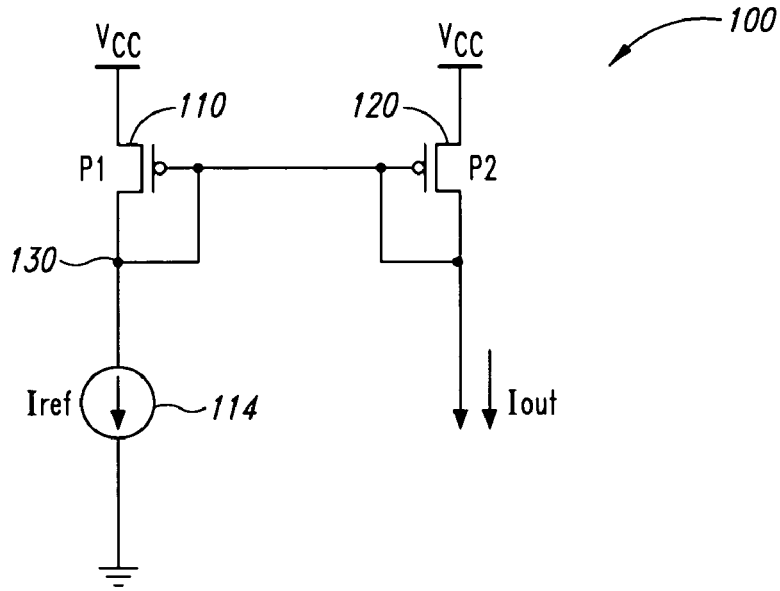
Fig. 1 (Background Art)
FIG. 1 is a schematic diagram of a conventional current mirror circuit.
Figure 2:
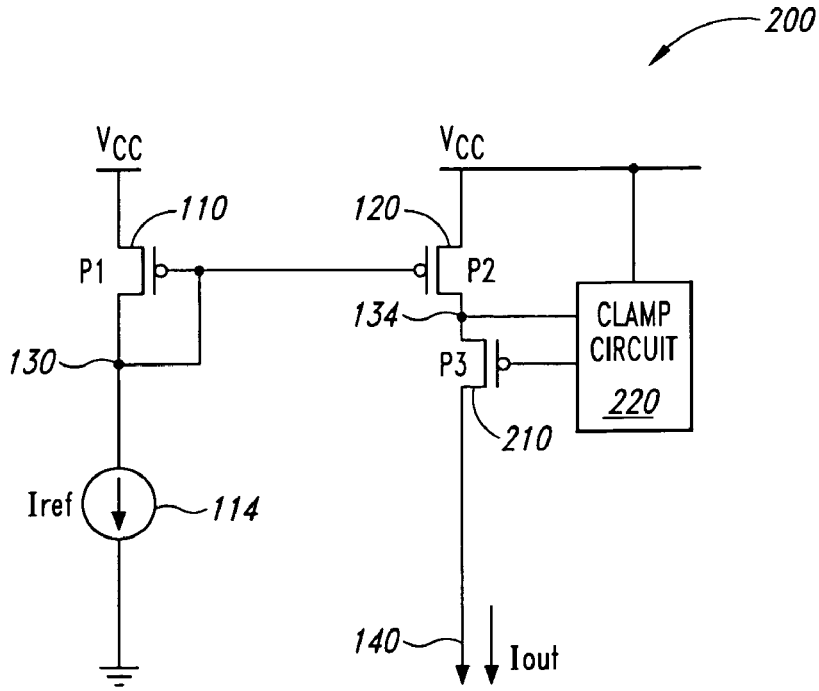
FIG. 2 is a schematic diagram of a current mirror circuit according to an embodiment of the present invention.

FIG. 2 illustrates a current mirror circuit 200 according to an embodiment of the present invention. The current mirror circuit 200 includes the PMOS transistors 110 and 120 and current reference source 114, previously described with reference to the conventional current mirror circuit 100 shown in FIG. 1. Additionally, the current mirror circuit 200 includes a PMOS transistor 210 to isolate the drain of the PMOS transistor 120 from an output 140, and further includes a clamp circuit 220 coupled to the power supply Vcc, the node 134, and the PMOS transistor 210. The reference current Iref is mirrored to an output current Iout provided at the output 140. The current mirror circuit 200 is less susceptible to Iout variation caused by channel length modulation than conventionally designed current mirror circuits, such as the current mirror circuit 100. As previously discussed, changes in Vds across the PMOS transistor 120, which can be caused by changes in Vcc, temperature, output loading, and the like, results in fluctuations of the Iout current. In order to reduce Iout variation, the clamp circuit 220 included in the current mirror circuit 200 is configured to stabilize Vds across the PMOS transistor 120 to the voltage that is set by the Vds (and Vgs) of the PMOS transistor 110. The clamp circuit 220 further biases the PMOS transistor 210, which as previously mentioned, isolates the drain of the PMOS transistor 210 so that the voltage of the node 134 can be clamped.

Figure 3:
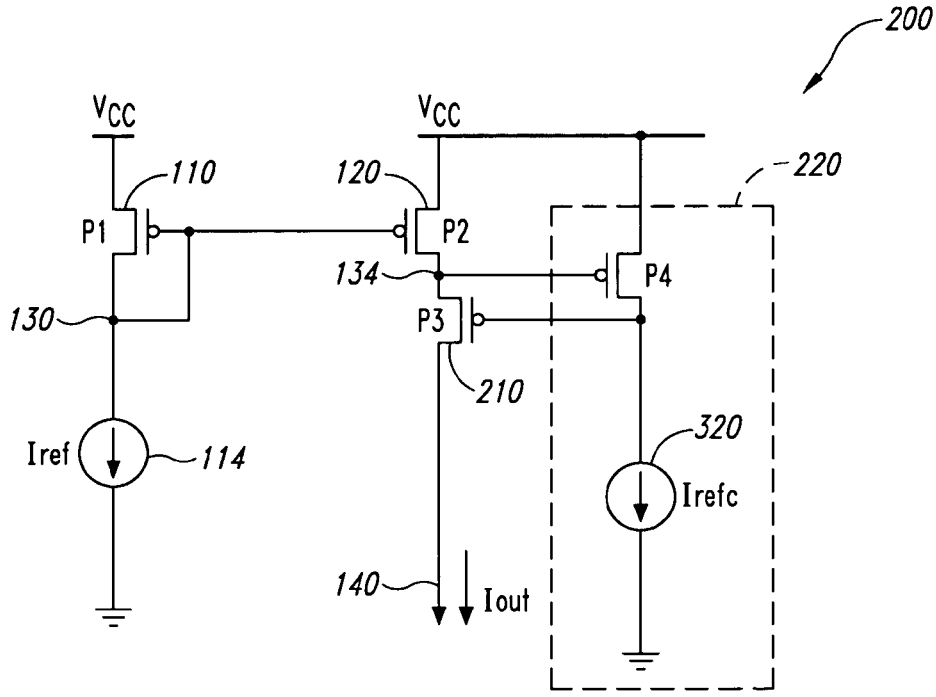
FIG. 3 is a schematic diagram of a current mirror circuit according to another embodiment of the present invention.

FIG. 3 illustrates the current mirror circuit 200 with a clamp circuit 220 according to an embodiment of the invention. The clamp circuit 220 of FIG. 3 includes a PMOS transistor 310 and a reference current source 320 providing a reference current Irefc that is equal to Iref provided by the current source 114. The PMOS transistor 310 is preferably matched to the PMOS transistors 110 and 120. In operation, the Vgs of the PMOS transistor 310 is set by Irefc. The Vds of the PMOS transistor 120 is stabilized by coupling the gate of the PMOS transistor 310 to the drain of the PMOS transistor 120 thereby setting the Vds of the PMOS transistor 120 to the Vgs of the PMOS transistor 310. With the PMOS transistor 310 matched to the PMOS transistor 110, and Irefc equal to Iref, the Vgs of the PMOS transistor 310 is matched to the Vgs of the PMOS transistor 110, and because the gate and drain are coupled together for the PMOS transistor 110 (i.e., Vgs=Vds of PMOS transistor 110), the Vds of PMOS transistor 120 is matched to the Vds of the PMOS transistor 110. As a result, the Vgs of the PMOS transistor 310 stabilizes the Vds across the PMOS transistor 120 to reduce fluctuations in the Iout current.

Figure 4:
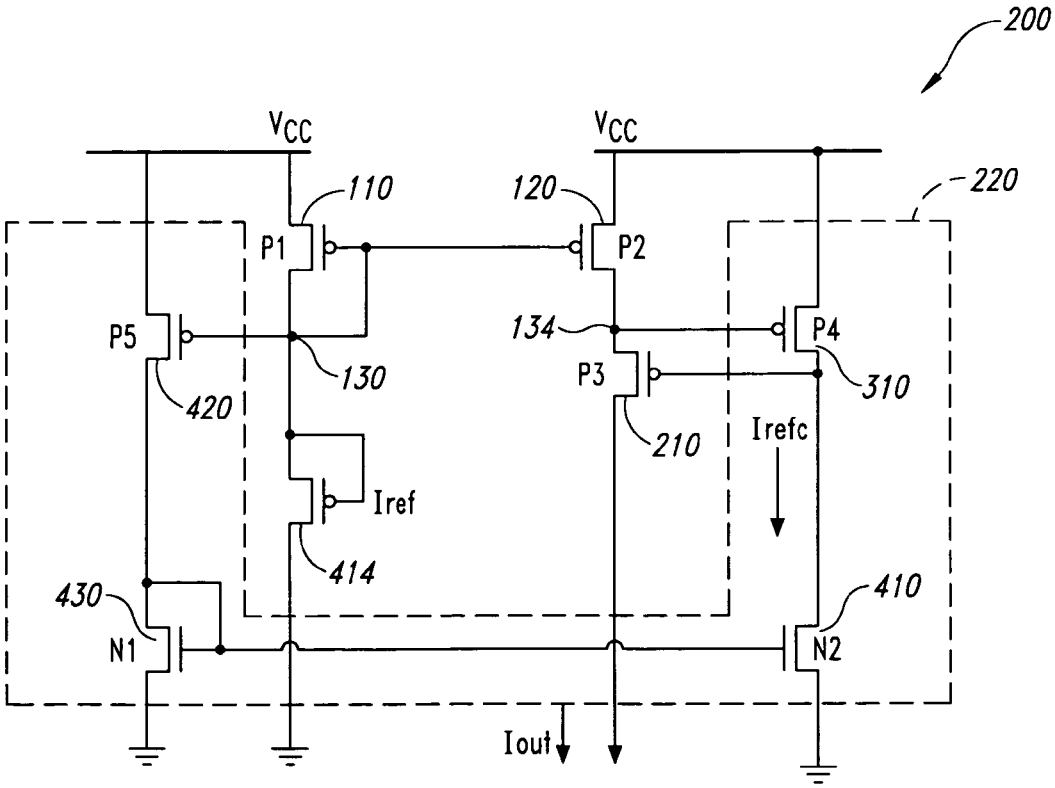
FIG. 4 is a schematic diagram of a current mirror circuit according to another embodiment of the present invention.

FIG. 4 illustrates a current mirror circuit 200 with the clamp circuit 220 having a reference current source 320 (FIG. 3) according to an embodiment of the invention. The current source 320 is represented in FIG. 4 by NMOS transistors 410, 430, and PMOS transistor 420. The PMOS transistor 420 is matched with the PMOS transistor 310, and the two NMOS transistors 410, 430 are matched to saturated NMOS transistor 414, which represents the current source 114 in the embodiment of FIG. 4.

In operation, the PMOS transistor 420 is coupled so that its Vgs is equal to the Vgs of the PMOS transistor 110, thereby setting the Vds of the PMOS transistor 420 equal to the Vds of the PMOS transistor 110. As a result, the current through the NMOS transistor 430 will be equal to Iref current through the NMOS transistor 414.

With the gates of the two NMOS transistors 410 and 430 tied together, the Irefc current through the NMOS transistor 410 is equal to the Iref current through the NMOS transistor 414 (i.e., Iref=Irefc). Under this condition, the Vgs of the PMOS transistor 310 is equal to the Vds of the PMOS transistor 110, which is used to stabilize the Vds of the PMOS transistor 120 and reduce Iout variations, as previously described.

In the embodiment shown in FIG. 4, the Irefc current through the PMOS transistor 310 can vary as voltage, temperature and loading vary. As known, the Vgs of the PMOS transistor 310 will consequently vary as well. Although the varying Vgs of the PMOS transistor 310 will affect the Vds across the PMOS transistor 120, which as previously explained causes Iout current variation, the degree of variation of Vgs is less than for an unclamped Vds of the PMOS transistor 120 due to the square-law relationship between drain current and Vgs of the PMOS transistor 310. This can be shown by the following equations:

$$I_{N2_1}-I_{N2_0}=\Delta I_{N2}=(1/2)\mu_n Cox(W_{N2}/L_{N2})(Vref-Vtn)^2(\lambda\Delta V) \quad (2)$$

where λ is the channel length modulation coefficient and $W_{N2}$ and $L_{N2}$ are the width and length of NMOS 410. With the PMOS transistor 310 in saturation, the ΔVgs caused by the variations in current can be approximated by $$\Delta Vgs=[2I_{N2_1}/\mu_p/Cox/(W_{P4}/L_{P4})]^{1/2}-[2I_{N2_0}/\mu_p/Cox/(W_{P4}/L_{P4})]^{1/2} \quad (3)$$

$$\Delta Vgs\approx(1/2)[\mu_n Cox(W_{N2}/L_{N2})/\mu_p/Cox/(W_{P4}/L_{P4})](Vref-Vtn)\lambda\cdot\Delta V \quad (4)$$

where $W_{P4}$ and $L_{P4}$ are the width and length of PMOS 310 and Vref is the gate voltage of NMOS 410 and NMOS 430.

ΔVds of the PMOS 120 will be the same as the ΔVgs of the PMOS 310. As a result, making the coefficient of ΔV, that is, the coefficient being equal to $$(1/2)[\mu_n Cox(W_{N2}/L_{N2})/\mu_p/Cox/(W_{P4}/L_{P4})](Vref-Vtn)\lambda \quad (5)$$

much smaller than 1 can reduce the ΔVds of the PMOS 120. As a result, as previously discussed, variation in Iout caused by channel length modulation can be reduced.

Figure 5:
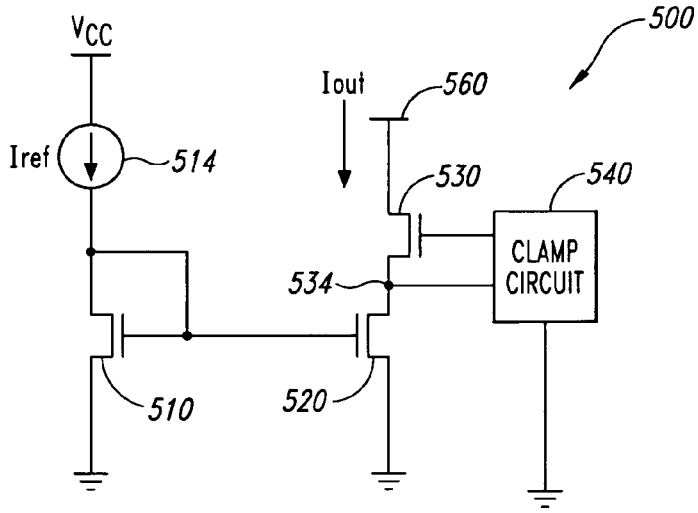
FIG. 5 is a schematic diagram of a current mirror circuit according to another embodiment of the present invention.

The previously described embodiments are PMOS current mirror circuits. However, alternative embodiments of the present invention include NMOS-current mirror circuits having voltage clamp circuitry to stabilize the output current. For example, FIG. 5 illustrates an NMOS current mirror circuit 500 including NMOS transistor 510 having a drain coupled to a gate, and further coupled to a current source 514 that provides a reference current Iref. An NMOS transistor 520 has a gate coupled to the gate of the NMOS transistor 510 to set the gate voltage. An NMOS transistor 530 is coupled to isolate a drain of the NMOS transistor 520 from an output 560. A clamp circuit 540 is coupled to a node 534 and is configured to stabilize Vds across the NMOS transistor 520 to the voltage that is set by the Vds (and Vgs) of the NMOS transistor 510, thereby stabilizing Iout. Although the circuitry of the clamp circuit 540 is not specifically shown in FIG. 5, it will be appreciated that those ordinarily skilled in the art will obtain sufficient understanding from the description provided herein to practice the invention with NMOS current mirror circuits.

Figure 6:
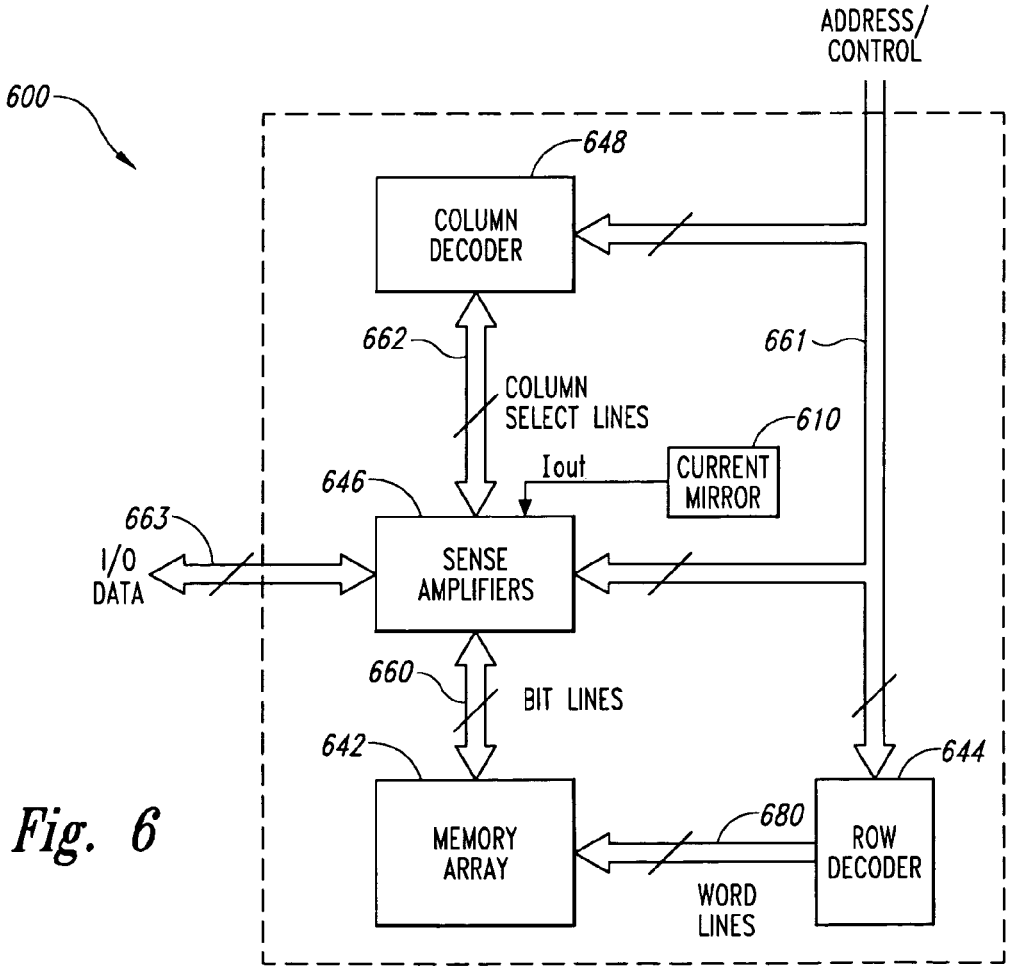
FIG. 6 is a block diagram of a memory system including a current mirror circuit according to an embodiment of the present invention.

FIG. 6 illustrates a memory system 600 including a current mirror circuit 610 according to an embodiment of the present invention. In one embodiment, the memory system 600 is included in a memory device. In an alternative embodiment, the memory system 600 is an embedded memory system. The memory system 600 includes a memory array 642, row and column decoders 644, 648 and a sense amplifier circuit 646. The current mirror circuit 610 is coupled to the sense amplifier circuit 646 to provide an output current Iout that is used as a reference current when sensing data from memory cells of the memory array 642, as will be described in more detail below. The memory array 642 includes a plurality of NOR flash memory cells (not shown) coupled to word lines 680 and digit lines 660 that are arranged into rows and columns, respectively. The digit lines 660 are connected to the sense amplifier circuit 646, while the word lines 680 are connected to the row decoder 644.

In operation, address and control signals, provided on address/control lines 661 coupled to the column decoder 648, sense amplifier circuit 646 and row decoder 644, are used, among other things, to gain read and write access to the memory array 642. The column decoder 648 is coupled to the sense amplifier circuit 646 via control and column select signals on column select lines 662. The sense amplifier circuit 646 receives input data to be written to the memory array 642 and outputs data read from the memory array 642 over input/output (I/O) data lines 663. Data is read from the cells of the memory array 642 by activating a word line 680 (via the row decoder 644), which couples all of the memory cells corresponding to that word line to respective digit lines 660. One or more digit lines 660 are also activated. When a particular word line 680 and digit line 660 are activated, the sense amplifier circuit 646 coupled to respective digit line detects and amplifies the conduction sensed through a given NOR flash memory cell by comparing a digit line current to a reference current. As previously mentioned, the reference current is provided by the current mirror circuit 610. Based on the comparison, the sense amplifier circuit 646 generates an output indicative of either "1" or "0" data. The previous description is a summary of the operation of the memory system 600. Operation of NOR flash memory cell-based memory systems, such as the memory system 600, is well known in the art, and a more detailed description has not been provided in order to avoid unnecessarily obscuring the invention.

Figure 7:
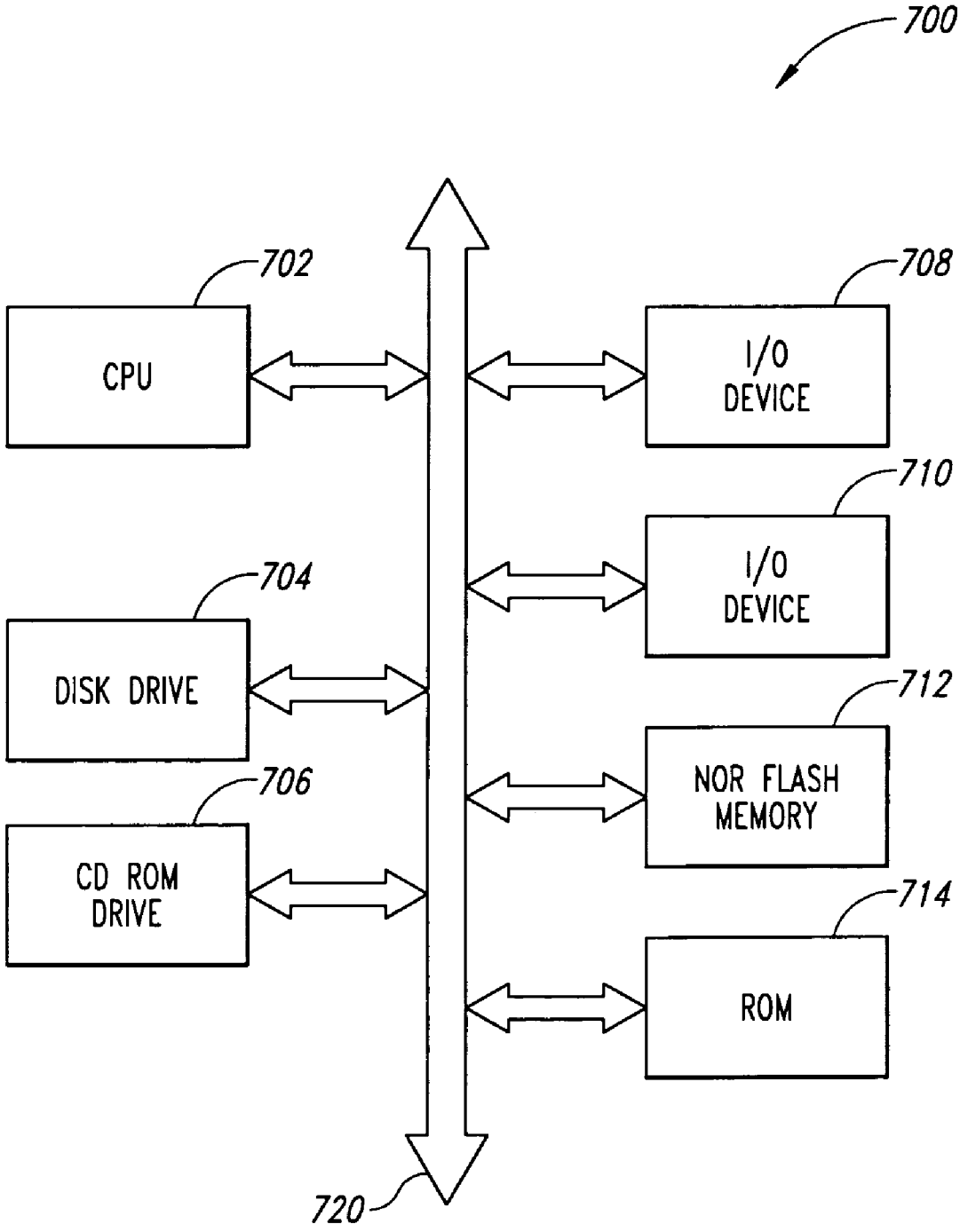
FIG. 7 is a block diagram of a processor-based system including the memory system of FIG. 6.

FIG. 7 is a block diagram of a processor-based system 700 including the NOR flash memory system 600 of FIG. 6. The processor-based system 700 may be a computer system, a process control system, an embedded system, or any other system employing a processor and associated memory. The system 700 includes a central processing unit (CPU) 702, such as a microprocessor, that communicates with the NOR flash memory 600 and an I/O device 708 over a bus 720. The bus 720 may be a series of buses and bridges commonly used in a processor-based system. A second I/O device 710 is illustrated in FIG. 7, but is optional. The processor-based system 700 may also include one or more data storage devices, such as disk drive 704 and CD-ROM drive 706, to allow the CPU 702 to store data in or retrieve data from internal or external storage media. Additional examples of typical storage devices include flash drives and digital video disk read-only memories (DVD-ROMs).

It will be understood that the embodiments shown in FIGS. 6 and 7 are intended to provide examples of applications for embodiments of the present invention, and are not intended to serve as a complete description of all the elements and features of an electronic system including a current mirror circuit according to an embodiment of the invention.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A circuit for providing an output current at an output, comprising:

a reference current source configured to provide a reference current;

a bias circuit coupled to the reference current source and configured to output a bias voltage according to the reference current;

an output transistor having a control node coupled to the bias circuit and further having first and second nodes, the output transistor operable to conduct current from the first node to the second node in accordance with the bias voltage; and a clamp circuit coupled to the output transistor and configured to clamp a voltage across the first and second nodes of the output transistor, the clamp circuit having a bias current source configured to provide a bias current and a second bias circuit coupled to bias current source and further coupled to the second node, the second bias circuit configured to provide a clamp voltage to the second node in accordance with the bias current.

2. The circuit of claim 1 wherein the bias circuit comprises a field effect transistor (FET) having a drain coupled to a gate of the bias circuit, the gate coupled to the control node of the output transistor.

3. The circuit of claim 1 wherein the output transistor comprises a p-channel FET.

4. The circuit of claim 1 wherein the bias current source comprises a bias current source configured to provide a bias current equal to the reference current.

5. The circuit of claim 4 wherein the bias current source comprises:

an n-channel FET having a drain coupled to the second bias circuit, the n-channel FET configured to conduct current in accordance with a voltage applied to a gate; and a third bias circuit coupled to the n-channel FET and configured to bias the gate to conduct a current equal to the reference current.

6. The circuit of claim 5 wherein the reference current source comprises a diode-coupled n-channel FET and the first bias circuit comprises a p-channel FET having a drain coupled to a gate, the third bias circuit comprises:

a p-channel FET matched to the p-channel FET of the first bias circuit and having a gate coupled to the gate of the p-channel FET of the first bias circuit;

a diode-coupled n-channel FET coupled to the p-channel FET of the third bias circuit and having a gate coupled to the gate of the n-channel FET coupled to the second bias circuit.

7. The circuit of claim 1 wherein the second bias circuit comprises a FET having a gate, source and drain, the source coupled to the first node of the output transistor, the gate coupled to the second node of the output transistor, and the drain coupled to the bias current source.

8. The circuit of claim 7 wherein the FET is a first FET and the circuit further comprises a second FET having a source coupled to the second node of the output transistor, a gate coupled to the drain of the first FET, and a drain coupled to the output of the circuit.

9. A current mirror circuit, comprising:

first and second field-effect transistors (FETs), the first FET diode coupled and having a gate coupled to a gate of the second FET;

a first current source coupled to a drain of the first FET and configured to provide a reference current;

a third FET having a gate coupled to a drain of the second FET;

a fourth FET having a gate coupled to a drain of the third FET and a source coupled to the drain of the second FET, an output current provided at a drain of the fourth FET; and a second current source coupled to a drain of the third FET and configured to provide a current equal to the reference current.

10. The current mirror circuit of claim 9 wherein the first, second, third, and fourth FETs comprise p-channel FETs.

11. The current mirror circuit of claim 9 wherein the first, second, and third FETS are matched.

12. The current mirror circuit of claim 9 wherein the first current source comprises an n-channel diode-coupled FET.

13. The current mirror circuit of claim 12 wherein the second current source comprises a fifth FET coupled to the third FET, a gate of the fifth FET biased to a voltage equal to the bias of a gate of the n-channel diode-coupled FET.

14. The current mirror circuit of claim 13, further comprising:

a sixth FET having a gate coupled to the gate of the first FET; and a second n-channel diode-coupled FET having a gate coupled to a drain of the sixth FET and further coupled to the gate of the fifth FET.

15. The current mirror circuit of claim 14 wherein the fifth FET, the n-channel diode-coupled FET of the first current source, and the second n-channel diode-coupled FET comprise matched n-channel FETs.

16. A memory system, comprising:

an array of memory cells;

a row address decoder coupled to the array of memory cells;

sense amplifiers coupled to the array of memory cells and configured to sense data stored by the memory cells;

a column address decoder coupled to the sense amplifiers; and a current mirror circuit coupled to the sense amplifiers, the current mirror circuit configured to provide an output current to the sense amplifiers for use as a reference current, the current mirror circuit comprising:

a reference current source configured to provide a reference current;

a bias circuit coupled to the reference current source and configured to output a bias voltage according to the reference current;

an output transistor having a control node coupled to the bias circuit and further having first and second nodes, the output transistor operable to conduct current from the first node to the second node in accordance with the bias voltage; and a clamp circuit coupled to the output transistor and configured to clamp a voltage across the first and second nodes of the output transistor.

17. The memory system of claim 16 wherein the bias circuit of the current mirror circuit comprises a field effect transistor (FET) having a drain coupled to a gate of the bias circuit, the gate coupled to the control node of the output transistor.

18. The memory system of claim 16 wherein the output transistor of the current mirror circuit comprises a p-channel FET.

19. The memory system of claim 16 wherein the bias circuit of the current mirror circuit is a first bias circuit and the clamp circuit comprises:

a bias current source configured to provide a bias current; and a second bias circuit coupled to bias current source and further coupled to the second node, the second bias circuit configured to provide a clamp voltage to the second node in accordance with the bias current.

20. The memory system of claim 19 wherein the bias current source comprises a bias current source configured to provide a bias current equal to the reference current.

21. The memory system of claim 20 wherein the bias current source comprises:

an n-channel FET having a drain coupled to the second bias circuit, the n-channel FET configured to conduct current in accordance with a voltage applied to a gate; and a third bias circuit coupled to the n-channel FET and configured to bias the gate to conduct a current equal to the reference current.

22. The memory system of claim 21 wherein the reference current source comprises a diode-coupled n-channel FET and the first bias circuit comprises a p-channel FET having a drain coupled to a gate, the third bias circuit comprises:

a p-channel FET matched to the p-channel FET of the first bias circuit and having a gate coupled to the gate of the p-channel FET of the first bias circuit;

a diode-coupled n-channel FET coupled to the p-channel FET of the third bias circuit and having a gate coupled to the gate of the n-channel FET coupled to the second bias circuit.

23. The memory system of claim 19 wherein the second bias circuit comprises a FET having a gate, source and drain, the source coupled to the first node of the output transistor, the gate coupled to the second node of the output transistor, and the drain coupled to the bias current source.

24. The memory system of claim 23 wherein the FET is a first FET and the circuit further comprises a second FET having a source coupled to the second node of the output transistor, a gate coupled to the drain of the first FET, and a drain coupled to the output of the circuit.

25. A processor-based system, comprising:

a processor configured to process instructions and data;

a data input/output device coupled to the processor; and a memory system coupled to the processor and configured to store instructions and data, the memory system comprising:

an array of memory cells;

a row address decoder coupled to the array of memory cells;

sense amplifiers coupled to the array of memory cells and configured to sense data stored by the memory cells;

a column address decoder coupled to the sense amplifiers; and a current mirror circuit coupled to the sense amplifiers, the current mirror circuit configured to provide an output current to the sense amplifiers for use as a reference current, the current mirror circuit comprising:

a reference current source configured to provide a reference current;

a bias circuit coupled to the reference current source and configured to output a bias voltage according to the reference current;

an output transistor having a control node coupled to the bias circuit and further having first and second nodes, the output transistor operable to conduct current from the first node to the second node in accordance with the bias voltage; and a clamp circuit coupled to the output transistor and configured to clamp a voltage across the first and second nodes of the output transistor.

26. The processor-based system of claim 25 wherein the bias circuit of the current mirror circuit comprises a field effect transistor (FET) having a drain coupled to a gate and the bias circuit, the gate coupled to the control node of the output transistor.

27. The processor-based system of claim 25 wherein the output transistor of the current mirror circuit comprises a p-channel FET.

28. The processor-based system of claim 25 wherein the bias circuit of the current mirror circuit is a first bias circuit and the clamp circuit comprises:

a bias current source configured to provide a bias current; and a second bias circuit coupled to bias current source and further coupled to the second node, the second bias circuit configured to provide a clamp voltage to the second node in accordance with the bias current.

29. The processor-based system of claim 28 wherein the bias current source comprises a bias current source configured to provide a bias current equal to the reference current.

30. The processor-based system of claim 29 wherein the bias current source comprises:

an n-channel FET having a drain coupled to the second bias circuit, the n-channel FET configured to conduct current in accordance with a voltage applied to a gate; and a third bias circuit coupled to the n-channel FET and configured to bias the gate to conduct a current equal to the reference current.

31. The processor-based system of claim 30 wherein the reference current source comprises a diode-coupled n-channel FET and the first bias circuit comprises a p-channel FET having a drain coupled to a gate, the third bias circuit comprises:

a p-channel FET matched to the p-channel FET of the first bias circuit and having a gate coupled to the gate of the p-channel FET of the first bias circuit;

a diode-coupled n-channel FET coupled to the p-channel FET of the third bias circuit and having a gate coupled to the gate of the n-channel FET coupled to the second bias circuit.

32. The processor-based system of claim 28 wherein the second bias circuit comprises a FET having a gate, source and drain, the source coupled to the first node of the output transistor, the gate coupled to the second node of the output transistor, and the drain coupled to the bias current source.

33. The processor-based system of claim 32 wherein the FET is a first FET and the circuit further comprises a second FET having a source coupled to the second node of the output transistor, a gate coupled to the drain of the first FET, and a drain coupled to the output of the circuit.

34. A method for providing an output current, comprising:

biasing an output transistor in accordance with a reference current to conduct the output current by generating the reference current through a diode-coupled field-effect transistor (FET); and conducting current equal to the reference current through a FET having a gate and source coupled across the output transistor by biasing a FET coupled thereto to have a gate voltage equal to the gate voltage of the diode-coupled FET to maintain a voltage across the output transistor.

35. The method of claim 34 wherein biasing an output transistor in accordance with a reference current comprises conducting the reference current through a diode-coupled FET having a gate coupled to a gate of the output transistor.

36. The method of claim 35 wherein conducting the reference current through a diode-coupled FET comprises conducting the reference current through a diode-coupled FET matched to the output transistor.

37. A method for generating an output current, comprising:

conducting a reference current through a diode-coupled first field-effect transistor (FET);

biasing a gate of a second FET matched to the diode-coupled first FET to a voltage equal to a gate voltage of the diode-coupled first FET;

conducting a current equal to the reference current through a third FET having a gate coupled to a drain of the second FET, the third FET matched to the second FET;

conducting the reference current through a diode-coupled fourth FET coupled to the diode-coupled first FET; and conducting the current equal to the reference current through a fifth FET coupled to the third FET having a gate biased to a voltage equal to a gate voltage of the diode-coupled fourth FET.

38. The method of claim 37 wherein the fourth FET and the fifth FET comprise matched n-channel FETs.

39. The method of claim 37 wherein the first, second, and third FETs comprise matched p-channel FETs.

40. A method for generating an output current, comprising:

conducting a reference current through a diode-coupled first p-channel field-effect transistor (FET);

biasing a gate of a second p-channel FET matched to the diode-coupled first p-channel FET to a voltage equal to a gate voltage of the diode-coupled first p-channel FET; and conducting a current equal to the reference current through a third p-channel FET having a gate coupled to a drain of the second p-channel FET, the third p-channel FET matched to the second p-channel FET.

* * * * *